US012796750B2

(12) United States Patent
Hooper et al.

(10) Patent No.: US 12,796,750 B2
(45) Date of Patent: Nov. 17, 2026

(54) GARMENT HAVING AN ADJUSTABLE OPENING BETWEEN PANELS

(71) Applicant: LULULEMON ATHLETICA CANADA INC., Vancouver (CA)

(72) Inventors: Deanna Tracy Hooper, Vancouver (CA); Min Hee Kim, Vancouver (CA); Hiu Yeung Cheung, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 125 days.

(21) Appl. No.: 18/127,876

(22) Filed: Mar. 29, 2023

(65) Prior Publication Data

US 2023/0309631 A1 Oct. 5, 2023

Related U.S. Application Data

(60) Provisional application No. 63/326,218, filed on Mar. 31, 2022.

(51) Int. Cl.
*A41D 1/02* (2006.01)
*A41D 27/28* (2006.01)

(52) U.S. Cl.
CPC ..... *A41D 1/02* (2013.01); *A41D 27/285* (2013.01)

(58) Field of Classification Search
CPC ..... A41D 1/02; A41D 27/285; A41D 27/28; A41D 2300/33
See application file for complete search history.

(56) References Cited

U.S. PATENT DOCUMENTS 811,872 A * 2/1906 Ries ..... A43C 1/00 24/712
1,136,282 A * 4/1915 Sihler ..... A41D 1/02 2/96
2,322,451 A * 6/1943 Jones ..... A41D 1/02 2/93
2,493,545 A * 1/1950 Muyleart ..... A41D 1/22
2,505,451 A * 4/1950 Weinstock ..... A41D 27/28 2/87
2,685,740 A * 8/1954 Augustin ..... A41D 27/08 33/12
3,045,243 A * 7/1962 Lash ..... A41D 27/28 2/87
3,086,215 A * 4/1963 Di Paola ..... A41D 27/28 2/87
3,153,793 A * 10/1964 Lepore ..... A41D 3/00 2/93
3,529,307 A * 9/1970 Belson ..... A41D 13/0012 2/94
3,731,319 A * 5/1973 O'Neill ..... B63C 11/04 2/2.17
4,408,356 A * 10/1983 Abrams ..... A41D 3/04 2/87
4,608,715 A * 9/1986 Miller ..... A41D 27/285 2/87

(Continued)

*Primary Examiner* — Katharine G Kane
(74) *Attorney, Agent, or Firm* — CONNEELY PC; Joseph Conneely

(57) ABSTRACT

Example of a garment, such as a jacket, pullover, hoodie, hat, or the like, having a cinchable or adjustable opening between panels is provided. When cinched, the inner panel's functionality is reduced or concealed. When uncinched, the inner panel's functionality is increased or exposed.

20 Claims, 15 Drawing Sheets

(56) References Cited

U.S. PATENT DOCUMENTS 4,722,099 A * 2/1988 Kratz ..... A41D 27/28 2/93
5,002,270 A * 3/1991 Shine ..... A63B 21/065 2/102
5,642,526 A * 7/1997 Thompson ..... A41D 13/02 2/DIG. 1
5,687,423 A * 11/1997 Ross ..... A41D 27/28 2/93
5,704,064 A * 1/1998 van der Sleesen .... A41D 27/28 2/108
6,339,845 B1 * 1/2002 Burns ..... A41D 27/285 2/243.1
7,540,037 B1 * 6/2009 Bittler ..... A41D 27/28 2/69
2003/0024028 A1 * 2/2003 Sleesen ..... A41D 13/0158 2/2.17
2004/0133962 A1 * 7/2004 Baumel ..... A41D 27/28 2/108
2004/0237168 A1 * 12/2004 Braun ..... A41D 27/28 2/93
2005/0044607 A1 * 3/2005 Sleesen ..... A41D 27/28 2/93
2005/0166298 A1 * 8/2005 Pieroranzio ..... A41D 27/10 2/69
2006/0174393 A1 * 8/2006 Meged ..... A41D 27/10 2/108
2007/0028362 A1 * 2/2007 Cash ..... A41D 1/08 2/227
2008/0120819 A1 * 5/2008 Rene ..... F41H 1/02 2/2.5
2009/0178174 A1 * 7/2009 Cash, Jr. ..... A41D 27/28 2/243.1
2010/0043116 A1 * 2/2010 Vereen ..... A41B 1/08 2/81
2013/0254969 A1 * 10/2013 Getzen ..... A41D 1/02 2/108
2014/0130232 A1 * 5/2014 Farron ..... A41D 1/02 2/95
2014/0157497 A1 * 6/2014 Audet ..... A41D 31/085 2/243.1
2014/0196192 A1 * 7/2014 Koller ..... A41D 3/00 2/85
2014/0338091 A1 * 11/2014 Kenney ..... A41D 13/0015 2/69
2016/0242474 A1 * 8/2016 Baschak ..... A41D 13/0015
2016/0270482 A1 * 9/2016 Krengel ..... A41D 1/06
2016/0331052 A1 * 11/2016 West ..... A41D 27/02
2017/0105466 A1 * 4/2017 Baschak ..... A41D 27/28
2017/0251738 A1 * 9/2017 Liu ..... A41D 27/28
2017/0303610 A1 * 10/2017 Maqbool ..... A41D 1/04
2018/0098586 A1 * 4/2018 Pezzimenti ..... A41D 3/00
2019/0365000 A1 * 12/2019 Simmons ..... A41D 27/28
2020/0170325 A1 * 6/2020 Mattioni ..... B32B 3/266
2021/0137177 A1 * 5/2021 Sun ..... A41D 27/24
2021/0361009 A1 * 11/2021 Polegato Moretti ..... A41D 31/102
2023/0225427 A1 * 7/2023 Klabunde ..... A41D 7/00 2/67
2023/0404182 A1 * 12/2023 Dammaschke ..... A41D 1/04
2024/0284993 A1 * 8/2024 Dolphin ..... A41B 1/08

* cited by examiner

GARMENT HAVING AN ADJUSTABLE OPENING BETWEEN PANELS

This application claims priority from and the benefit of the filing date of U.S. Provisional Patent Application No. 63/326,218, filed Mar. 31, 2022, and the entire content of such application is incorporated herein by reference.

FIELD

This application relates to the field of apparel, and more specifically, to a garment such as a jacket, pullover, hoodie, hat, or the like having a cinchable or adjustable opening between panels of the garment.

BACKGROUND

Consumers are demanding high performance activewear, sportswear, and outerwear. This is especially so for garments such as jackets, pullovers, and hoodies used for running, jogging, walking, stretching, exercising, other athletic performance outdoors or indoors and any other casual activity such as walking. Such garments should be as light as possible but must still provide effective weatherproofing for wet weather, sealing for windy conditions, and adequate insulation for cold weather. Moreover, such garments should provide adequate ventilation to keep a wearer from overheating even in wet, windy, and cold weather. One problem with existing garments is that while they may be adequately weatherproofed and/or insulated for use in wet, windy, and cold weather, a wearer may become overheated due to a lack of effective ventilation when the weather is warm and dry. Another problem with existing garments is their general lack of versatility in view of wearers' demands for integrated features that would enable wearers to alter the appearance, characteristics, or performance features of their garments.

SUMMARY OF THE APPLICATION

In one aspect, a garment, such as a jacket, pullover, hoodie, hat, or the like, having a cinchable or adjustable vent is provided. When cinched, airflow through the vent into the garment is reduced. When uncinched, airflow through the vent into the garment is increased.

In one aspect, a garment, such as a jacket, pullover, hoodie, hat, or the like, having a cinchable or adjustable opening between panels is provided. When cinched, the functionality of the inner panel is reduced, concealed, covered, or disabled. When uncinched, the functionality of the inner panel functionality is increased, exposed, uncovered, or enabled.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

Figure 1:
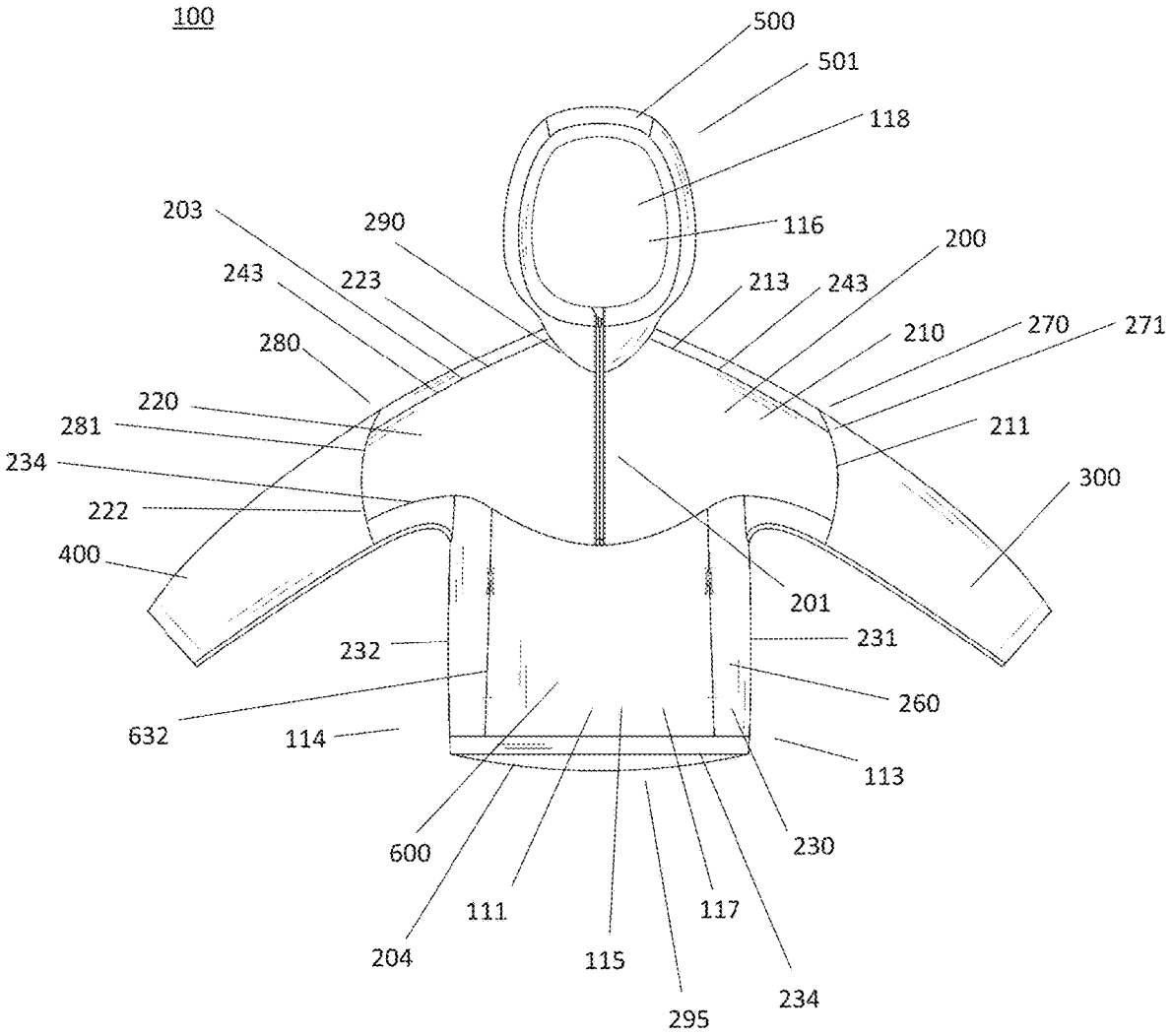
FIG. 1 is a front view illustrating an example garment having a cinchable or adjustable vent.
Figure 2:
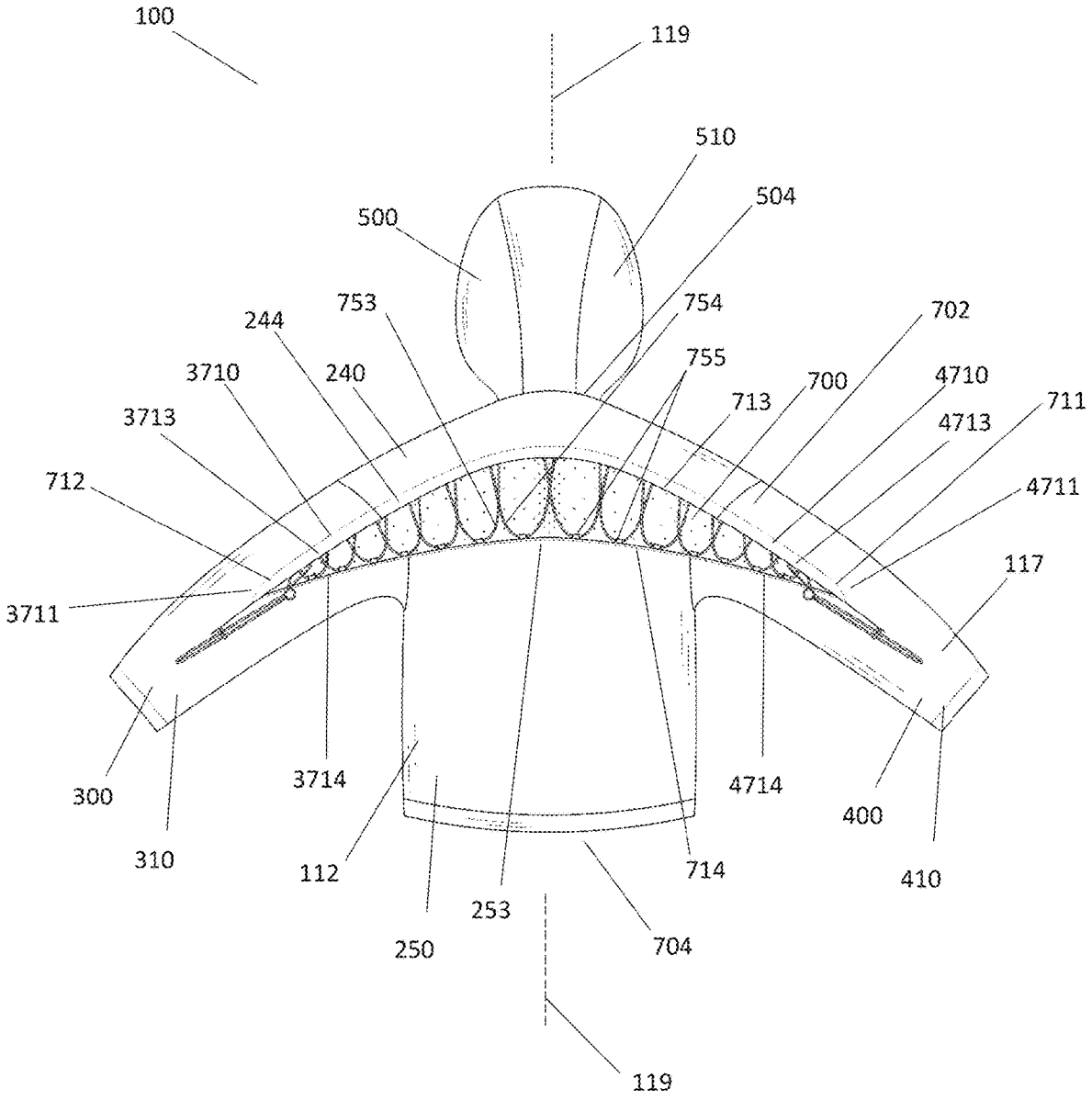
FIG. 2 is a rear view thereof showing the cinchable or adjustable vent in an opened position.
Figure 3:
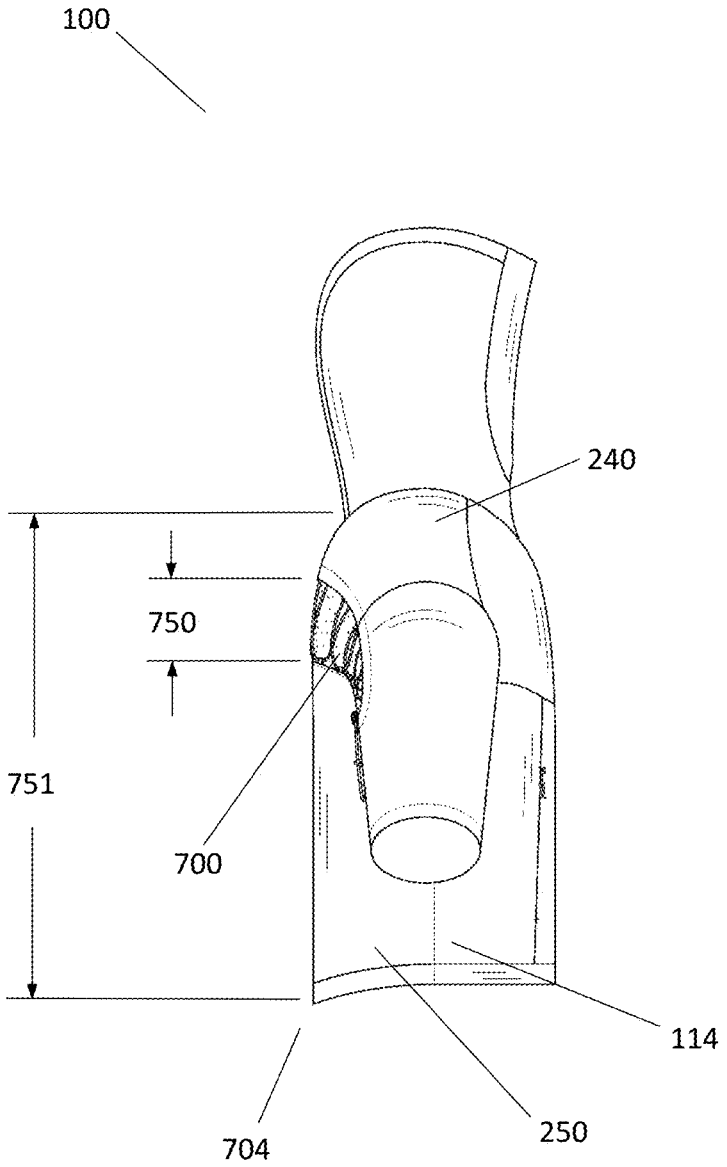
FIG. 3 is a left side view thereof, the right side view being a mirror image thereof.
Figure 4:
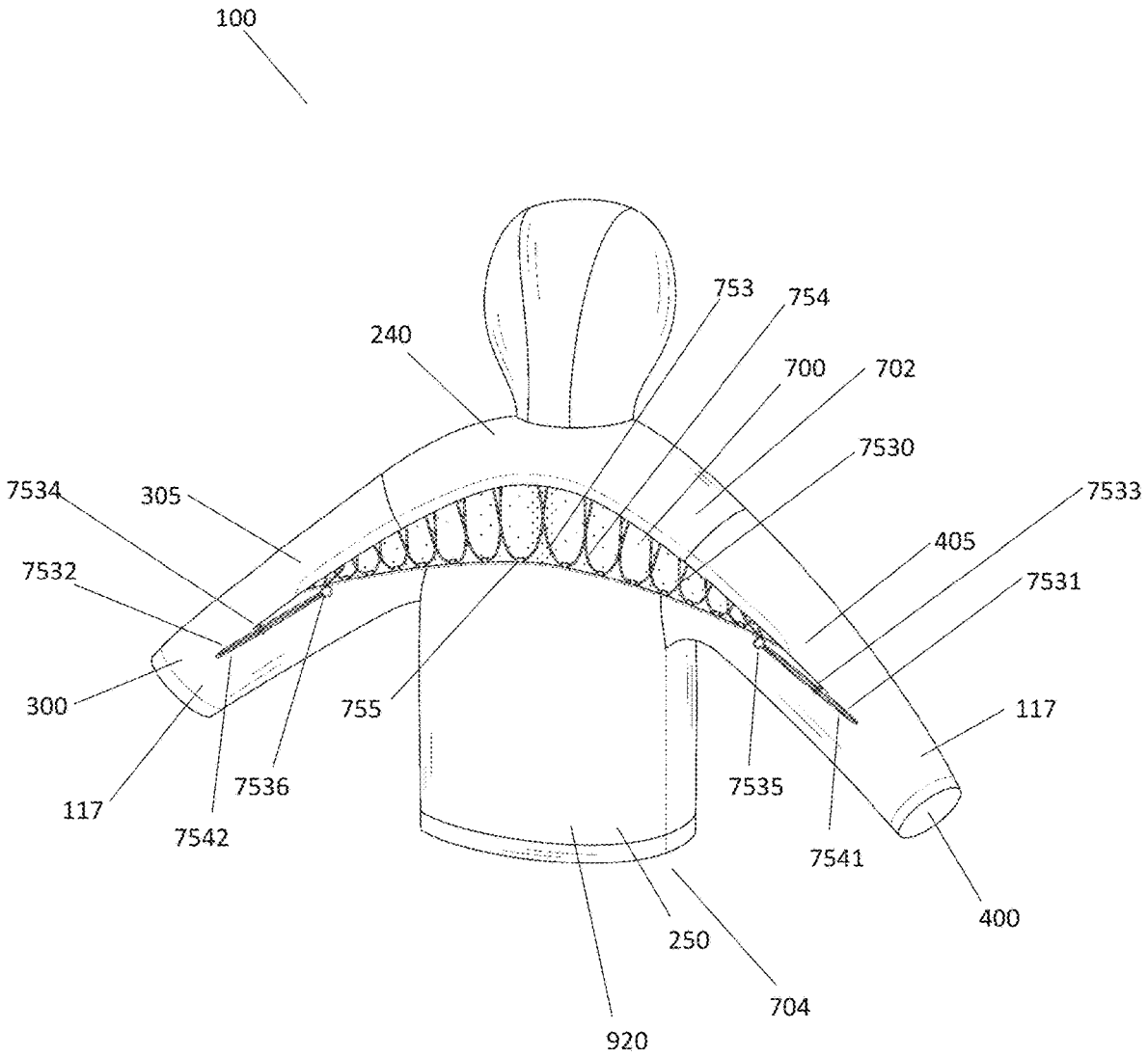
FIG. 4 is a rear perspective view thereof.
Figure 5:
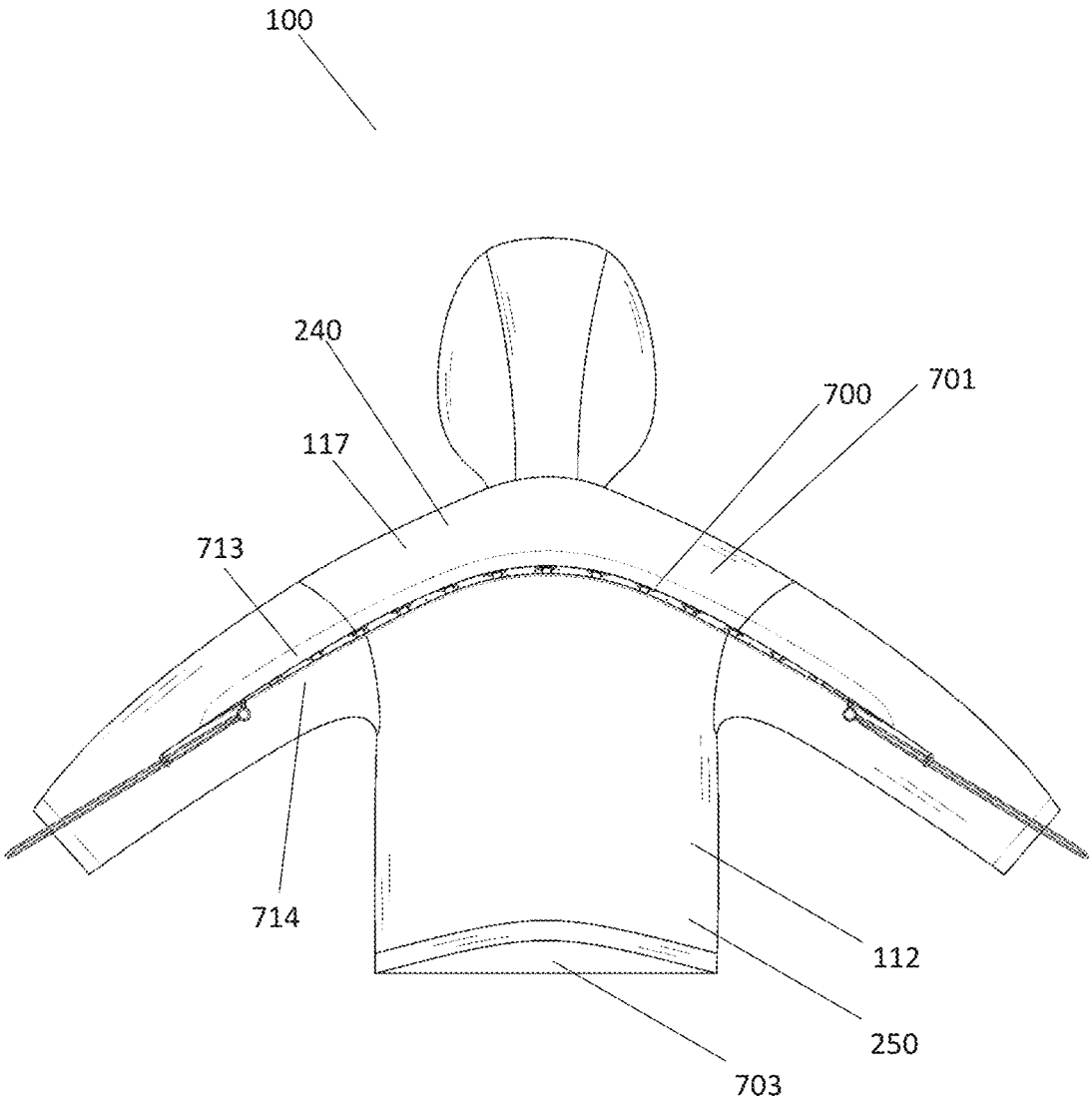
FIG. 5 is a rear view thereof illustrating the example garment of FIG. 1 with the vent thereof shown in a closed position.
Figure 6:
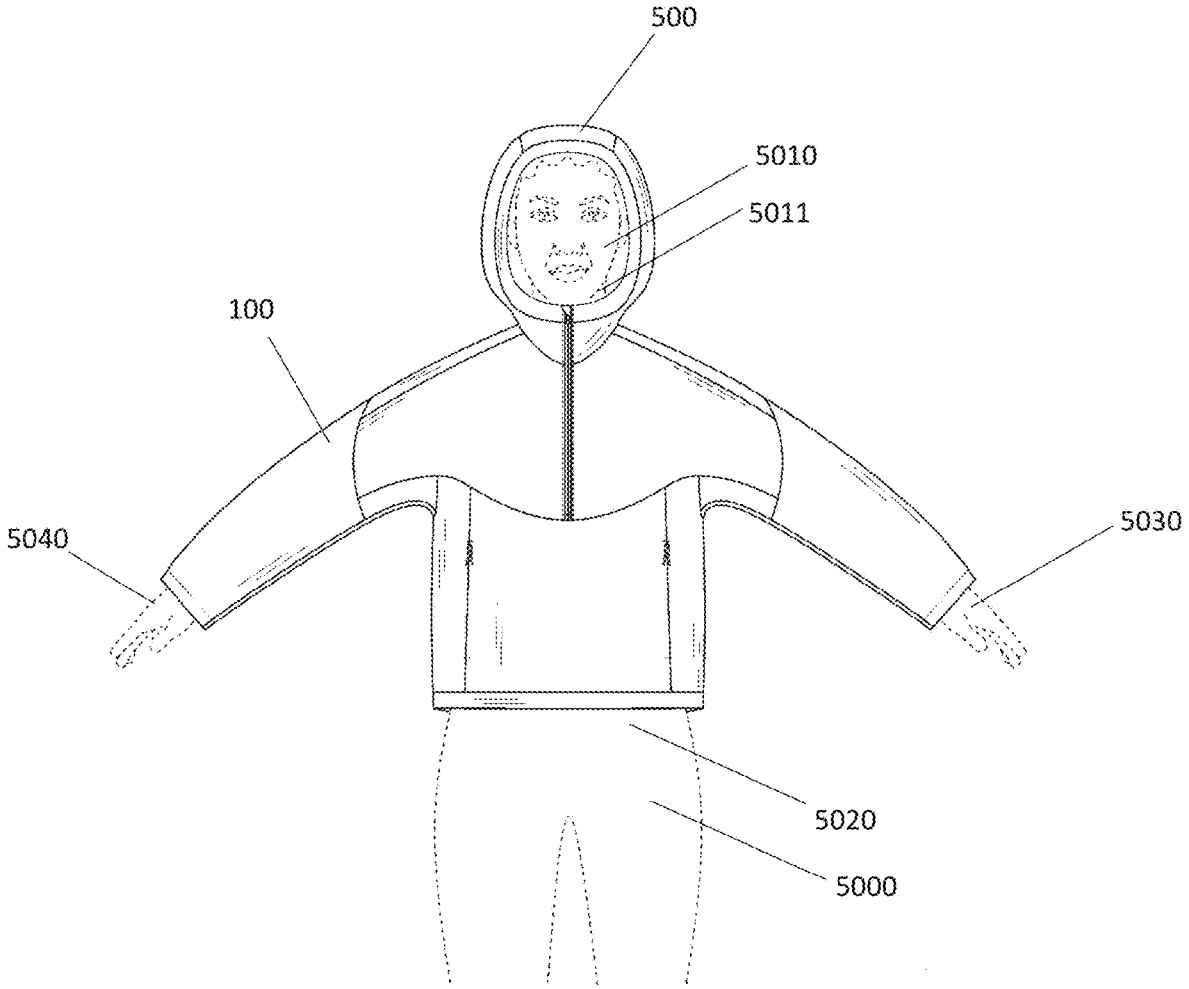
FIG. 6 is a front view thereof showing the example garment of FIG. 1 being worn by a wearer.
Figure 7:
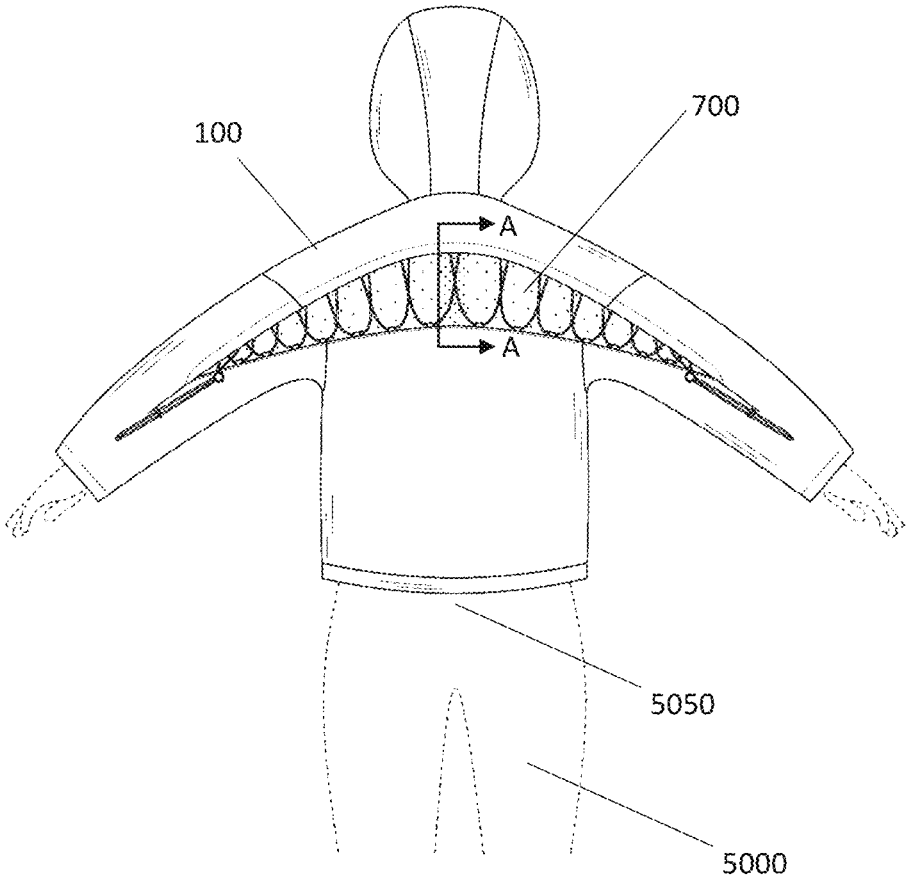
FIG. 7 is a rear view thereof.
Figure 8:
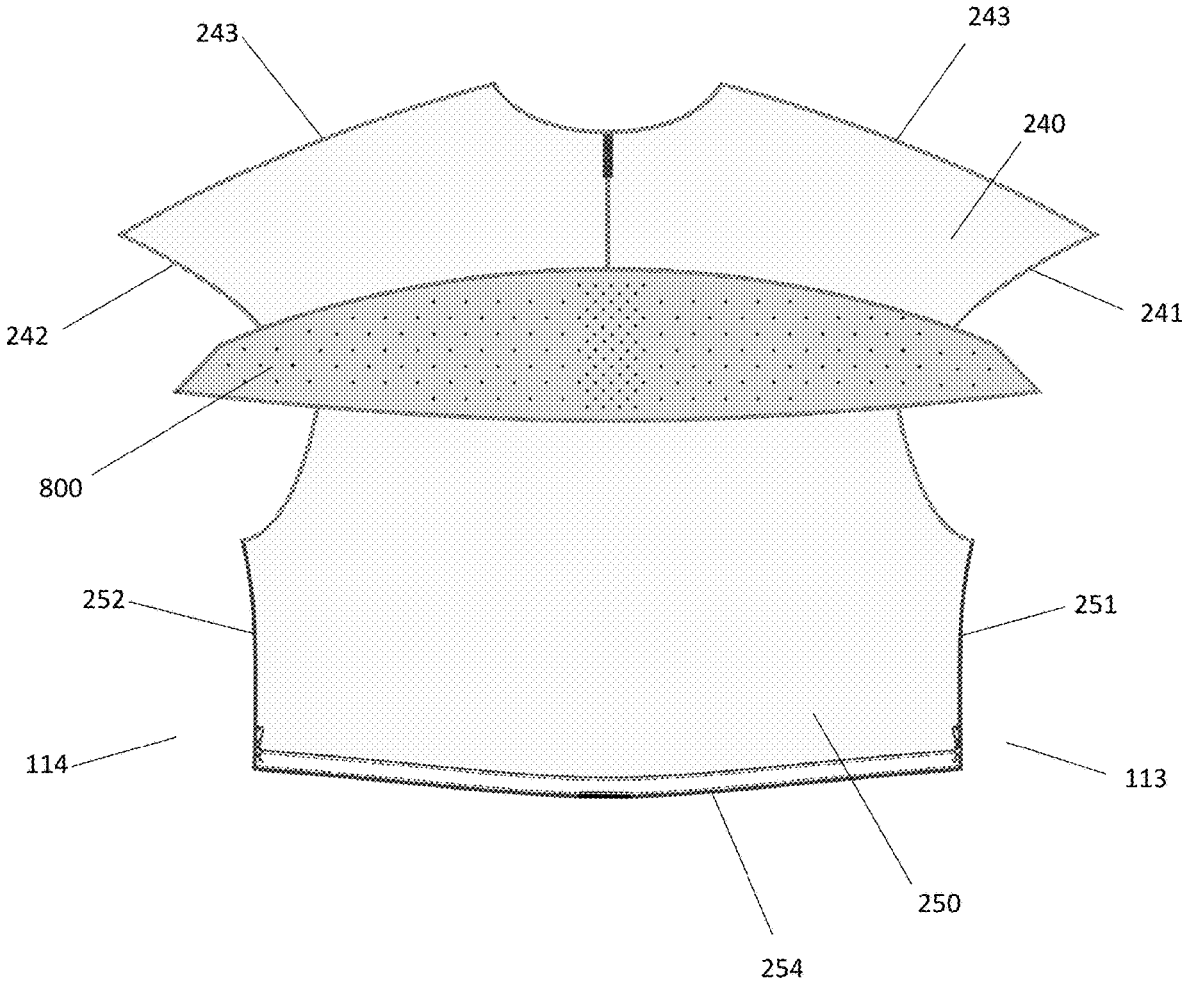
FIG. 8 is an inside front view illustrating the upper and lower back panels and the vent panel of the example garment of FIG. 1 in isolation.

FIG. 1 is a front view illustrating an example garment 100 having a cinchable or adjustable opening (or openings) or vent (or vents) 700 thereof shown in an opened position 702 (see FIG. 2). FIG. 2 is a rear view thereof. FIG. 3 is a left side view thereof, the right side view being a mirror image thereof. FIG. 4 is a rear perspective view thereof. FIG. 5 is a rear view thereof illustrating the example garment 100 of FIG. 1 with the vent 700 thereof shown in a closed position 701. FIG. 6 is a front view thereof showing the example garment 100 of FIG. 1 being worn by a wearer 5000 (e.g., a female wearer). FIG. 7 is a rear view thereof.

The garment 100 may be a jacket, coat, parka, hoodie, half-zip hoodie, or the like. As shown in FIGS. 1-7, the garment (e.g., half-zip hoodie) 100 has a front side (or front) 111, a back side (or back) 112, a first (e.g., right) side 113, a second (e.g., left) side 114, an outside 115, an inside 116, an outer surface 117, an inner surface 118, and a central axis (or centre line) 119.

The garment 100 includes: a body (or body portion) 200; first (or right) and second (or left) sleeves 300, 400 attached (e.g., connected, sewn, glued, bonded, coupled, joined, etc.) to the body 200 at respective armhole openings 270, 280 of the body 200; and, at least one cinchable or adjustable slit, opening, or vent 700 formed on the back 112 of the garment 100. The vent 700 is shown in its opened and closed positions 702, 701 in FIGS. 2-4 and FIG. 5, respectively. In some embodiments, the garment 100 can include a hood 500 attached to the body portion 200 at a neck opening 290 of the body 200.

In one embodiment, the body 200 is for covering at least a portion of the torso 5020 of the wearer 5000; the sleeves 300, 400 are for covering at least a portion of the respective arms 5030, 5040 of the wearer 5000; and, the hood 500 is for covering at least a portion of the head 5010 and neck 5011 of the wearer 5000.

The body portion 200 includes: at least one front panel 260 which can be a single panel or two or more panels joined together to form the front panel. For example, the front panel 260 can comprise a first (or right) and second (or left) upper front panels (or fabric panels) 210, 220 and a lower front panel (or fabric panel) 230 attached to the first and second front panels 210, 220. The body portion 200 also includes a back panel 920 that can be a single panel or two or more panels. In the illustrated example, the back panel 920 can comprise an upper back panel (or fabric panel) 240 and a lower back panel (or fabric panel) 250.

Upper edges 213, 223, 243 of the first and second upper front and upper back panels 210, 220, 240 form the upper edge 203 of the body 200 (i.e., at the neck opening 290). Lower edges 234, 254 of the lower front and lower back panels 230, 250 form the lower edge 204 of the body 200 (i.e., at the waist opening 295). First (or right) and second (or left) side edges 211, 222 of the first and second front panels 210, 220, a first (or right) and second (or left) side edges 231, 232 of the lower front panel 230, a first (or right) and second (or left) side edges 241, 242 of the upper back panel 240, and a first (or right) and second (or left) side edges 251, 252 of the lower back panel 250 form a first (or right) and second (of left) edges 271, 281 of the first (or right) and second (or left) arm openings 270, 280 of the body 200.

In one embodiment, the lower front portion 230 of the body 200 includes at least one pocket 600 formed therein.

Referring to FIGS. 2 and 5, the lower edge 244 of the upper back panel 240 and the upper edges 3713, 4713 of first and second cutouts 3711, 4711 of the first and second sleeves 300, 400 form an upper flap, lip, or edge 713 on the back 112 of the garment 100. Similarly, the upper edge 253 of the lower back panel 250 and the lower edges 3714, 4714 of the first and second cutouts 3710, 4710 of the first and second sleeves 300, 400 form a lower flap, lip, or edge 714 on the back 112 of the garment 100. The upper and lower edges 713, 714 extend horizontally (or approximately horizontally) across the back 112 of the garment 100 from a first (or right) end (or edge) 711 positioned at the inner end (or edge) 4711 of the second cutout 4710 located proximate an elbow portion 405 (i.e., where the elbow of the wearer 5000 would be located when the garment 100 is worn) of the second sleeve 400 to a second (or left) end (or edge) 712 positioned at the inner end (or edge) 3711 of the first cutout 3710 located proximate an elbow portion 305 of the first sleeve 300. The upper and lower edges 713, 714 are not attached between the first and second ends 711, 712 thus forming a slit, opening, or vent 700.

In one embodiment, one or more of the panels 210, 220, 230, 240, 250, 260, 310, 410, 510, 920 of the body 200, sleeves 300, 400, and hood 500 of the garment 100 may form the outer panel or outer layer 920 of the garment 100 and the vent 700 may be formed in this outer panel or outer layer 920. In a further embodiment, the vent 700 may be formed in one of the upper back panel 240 and the lower back panel 250. In yet a further embodiment, the garment 100 may include more than one vent 700. In yet a further embodiment, a vent panel 800 may be an inner panel, an inner layer, or an inner liner, or portions thereof, of the garment 100. The outer panel 920 on the back 112 of the garment 100 may comprise one or more outer panels and the vent panel 800 may comprise one or more inner panels.

In one embodiment, the vent 700 may be crescent or bow-shaped being wider at the central axis 119 on the back 112 of the garment 100 and tapering to narrower points at each end 711, 712 and being concave in a downward direction toward the lower edge 204 of the garment 100. Of course, the vent 700 may be shaped differently (e.g., rectangular, semi-circular, straight edged, etc.).

In addition, the garment 100 comprises a cord 753 that traverses the opening. The cord 753 can be one or more shockcords, drawcords, drawstrings, or the like. In the illustrated example of FIG. 2, the cord 753 comprises two cords 753 and 754 attached to (or between) the respective upper and lower edges 713, 714 at the vent 700. One or more fasteners 755 attached to the outer panel 920 proximate to the vent 700 are configured to secure the cord 753. The cord 753 can slidably pass through the one or more fasteners 755.

In one embodiment, the one or more cords 753, 754 may consist of one or more drawstrings, drawcords, cords, or shockcords that are laced or threaded through a plurality of fasteners 755 formed in or attached to and spaced along the upper and lower edges 713, 714 at the vent 700. In one embodiment, the cord 753 may be in the form of a continuous loop. For example, in one embodiment, the cord 753 can be a single cord traversing across the vent 700. To open, close or reduce the height 750 of the vent 700, and hence reduce the level of ventilation (i.e., airflow through the back 112 of the garment 100) provided by the vent 700, one or more cord locks 7535, 7536 are provided to selectively adjust tension in the cord 753. The one or more cord locks 7535, 7536 are configured to hold the cord 753 in a set position for selectively adjusting tension in the cord 753 and can comprise at least one of: a cord lock, a toggle, a buckle, a snap fastener, a button, a hook, a loop, a knot, a series of cord locks, a series of toggles, a series of buckles, a series of snap fasteners, a series of buttons, a series of hooks, a series of loops, and a series of knots.

In the illustrated example, the cords 753, 754 have their respective first (or right) and second (or left) ends 7531, 7532, 7541, 7542 attached or brought in close proximity at the respective first and second ends 711, 712 at the vent 700. The first and second ends 7531, 7532, 7541, 7542 of the shockcords 753, 754 can extend from or beyond the first and second ends 711, 712 at the vent 700. The first and second ends 7531, 7532, 7541, 7542 of the shockcords 753, 754 may be held or trained along the respective sleeves 400, 300 of the garment 100 by passing the shockcord ends 7531, 7532, 7541, 7542 through respective sleeve loops 7533, 7534 attached to the outer surface 117 of each sleeve 400, 300 below the respective elbow portions 405, 305 thereof.

To reduce the height 750 of the vent 700, and hence reduce the level of ventilation (i.e., airflow through the back 112 of the garment 100) provided by the vent 700, the wearer 5000 can release one or more of the cord locks 7535, 7536 and pulls on one or both ends 7531, 7532, 7541, 7542 of the shockcords 753, 754. This "cinching" action increases tension in the shockcords 753, 754 which in turn pulls on the fasteners (e.g., loops) 755 attached to the upper and lower edges 713, 714 of the vent 700 moving them between the opened position 702 and the closed position 701 (and positions therebetween). The wearer 5000 may then engage one or more of the cord locks 7535, 7536 to lock the shockcords 753, 754 and the upper and lower edges 713, 714 of the vent 700 in place. To increase the height 750 of the vent 700, and hence increase the level of ventilation (i.e., airflow through the back 112 of the garment 100) provided by the vent 700, the wearer 5000 releases one or more of the cord locks 7535, 7536 and pulls on one or more of the upper and lower edges 713, 714 of the vent 700 to separate the upper and lower edges 713, 714. This "uncinching" action reduces tension in the shockcords 753, 754 as applied to the loops 755 attached to the upper and lower edges 713, 714 of the vent 700 allowing the upper and lower edges 713 to be moved between the closed position 701 and the opened position 702 (and positions therebetween). The wearer 5000 may then engage one or more of the cord locks 7535, 7536 to lock the shockcords 753, 754 and the upper and lower edges 713, 714 of the vent 700 in place.

In one embodiment, the cord or cords 753, 754 can be made from one or more of polyester, braided polyester, paracord, braided nylon, flexible LED, recycled nylon, and recycled polyester. The cord or cords 753, 754 can further be one or more of reflective, glow in the dark, light reactive, heat reactive, water reactive, reactive to a specific chemical, transparent, and/or translucent.

In the closed position 701, the vent 700 is covered or at least partially covered. In particular, in the closed position 701, the lower edge 714 is drawn closer to the upper edge 713. In one embodiment, the upper edge 713 may overlap or partially overlap the lower edge 714 in the closed position 701. In the opened position 702, the vent 700 is uncovered or at least partially uncovered. In particular, in the opened position 702, the lower edge 714 is separated from at least the central portion of the upper edge 713 (e.g., proximate the central axis 119).

As shown in FIG. 5 and as mentioned above, in the closed position 701, the bottom edge 714 and hence at least the lower back panel 250 of the garment 100 is raised which raises the position of at least the lower edge 254 of the lower back panel 250 thus, in some implementations and embodiments of a garment and/or vent (e.g., rectangularly shaped inner panel), may reduce the length (e.g., from upper edge 203 to lower edge 204) of the back 112 of the body 200 of the garment 100 and hence the fit of the garment 100. In particular, the lower back panel 250 is moveable between a lowered position 704 and a raised position 703, and vice versa, by unfastening and fastening (or tensioning and untensioning, or tightening and loosening, etc.) the one or more cords 753, 754, respectively. As such, and advantageously, operation of the one or more cord 753, 754 adjusts the spacing 750 between the upper and lower edges 713, 714 and hence the height 750 of the vent 700 and allows a wearer 5000 to easily transform (or reconfigure, repurpose, convert, etc.) the garment 100 into a shorter length garment 100 (at least on the back 112). This allows the wearer 5000 to continue to wear the garment 100 when weather conditions change (e.g., the temperature drops, raises, etc.) or when the wearer 5000 desires a different look or fit. The garment 100 may be easily returned to its full length again when desired (e.g., when weather conditions change, when a new look is desired, etc.) by the wearer's operation of the one or more cords 753, 754.

Figure 9:
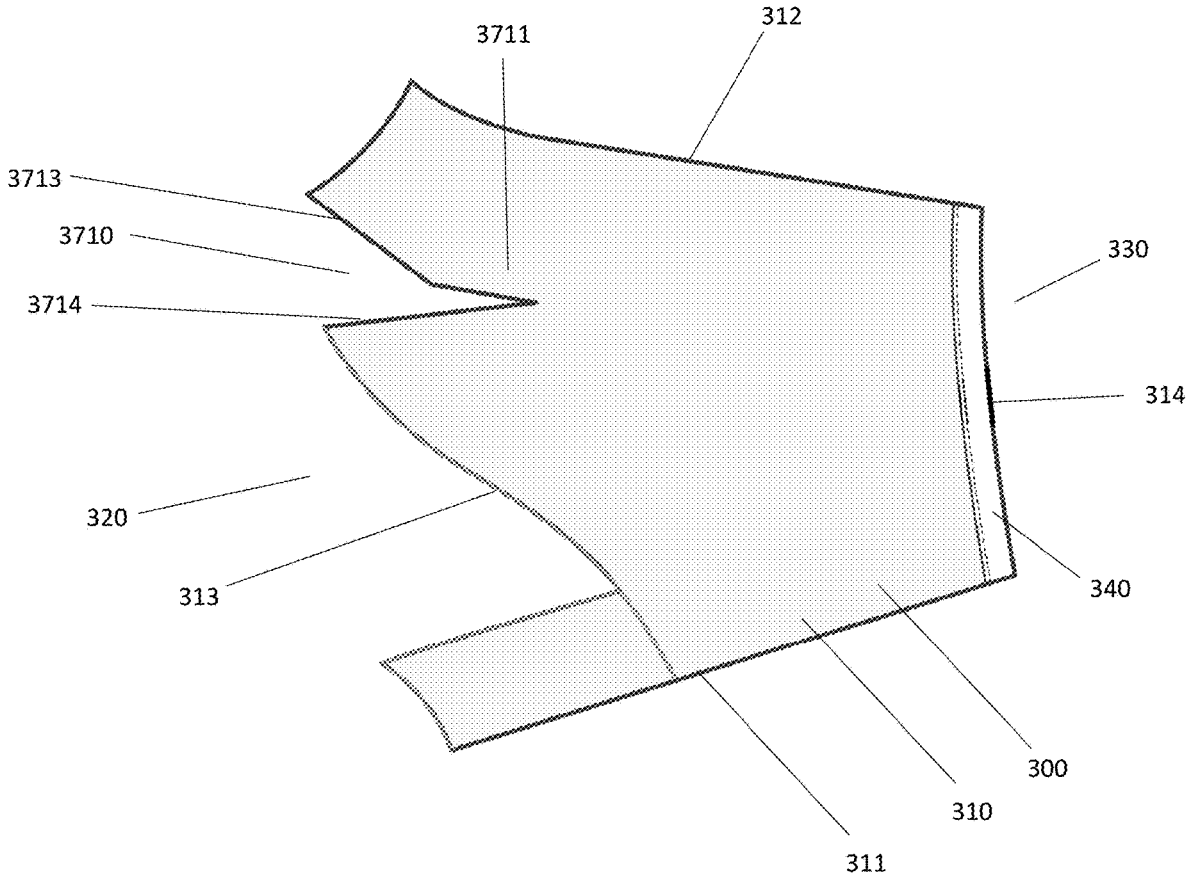
FIG. 9 is a front view illustrating a sleeve panel of the example garment of FIG. 1 laid flat, in isolation, and with the side edges thereof unattached.

FIG. 9 is a front view illustrating a sleeve panel (e.g., 310) of the example garment 100 of FIG. 1 laid flat, in isolation, and with the side edges 311, 312 thereof unattached. Each sleeve (e.g., 300) includes a sleeve panel (or fabric panel) 310 having a first (or right) side edge 311, a second (or left) side edge 312, an upper (or shoulder) edge 313, and a lower (or cuff) edge 314. The first and second side edges 311, 312 of the sleeve panel 310 are attached to form the tubular sleeve 300 having an arm opening 320 (defined by edge 313) and a hand opening 330 (defined by edge 314) with a cuff 340. The sleeve panel 310 and hence sleeve 300 may be elongate and tapered from the upper (or shoulder) edge 313 to the lower (or cuff) edge 314. The upper edge (e.g., 313) of each sleeve (e.g., 300) may be attached to the edge (e.g., 271) of the respective arm opening (e.g., 270) of the upper portion 200 of the garment 100.

In one embodiment, respective cutouts 3710, 4710 are formed in the first and second sleeve panels 310, 410 of the first and second sleeves 300, 400 at the respective upper edges 313, 314 thereof. Each cutout 3710, 4710 has a respective upper edge 3713, 4713, lower edge 3714, 4714, and inner end (or edge) 3711, 4711. These cutouts 3710, 4710 are used to form the vent 700 as described further below.

Figure 10:
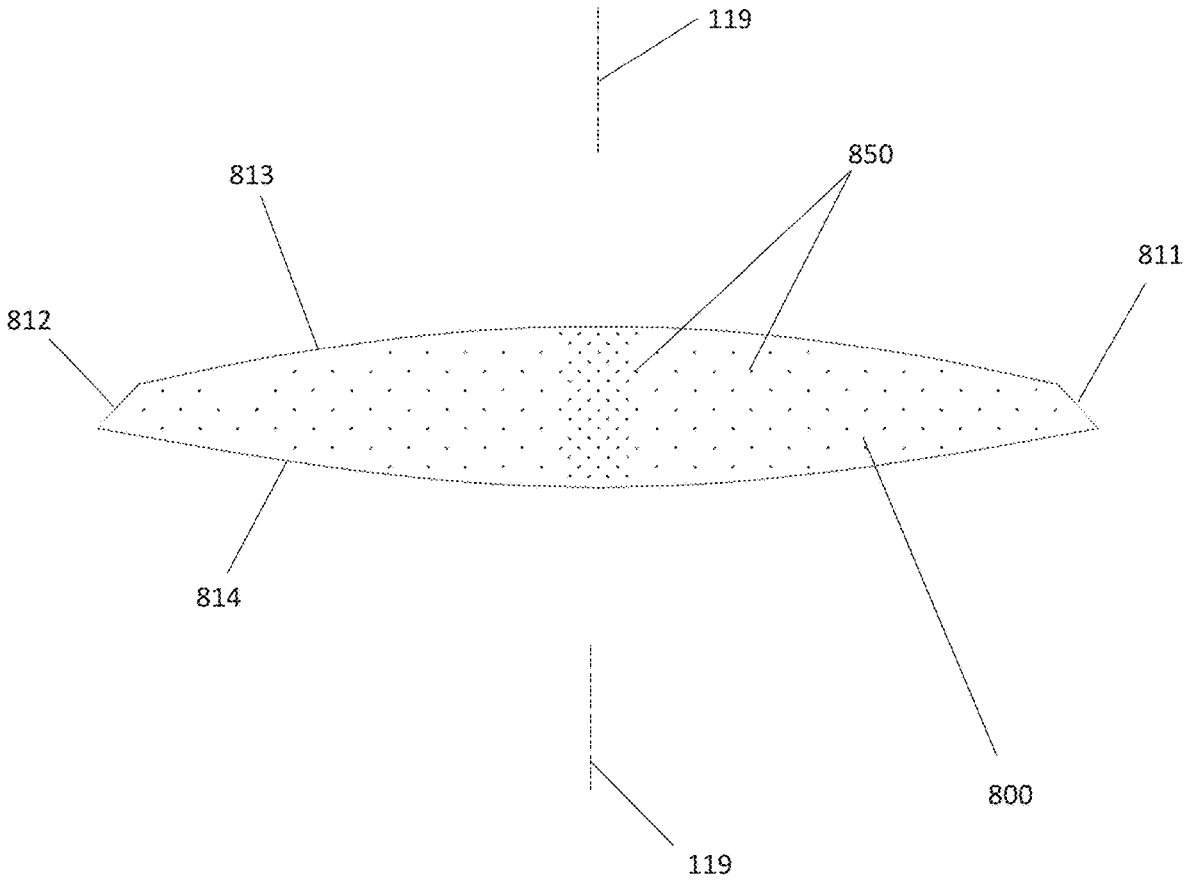
FIG. 10 is a detail view illustrating the vent panel of the example garment of FIG. 1 in isolation.
Figure 11:
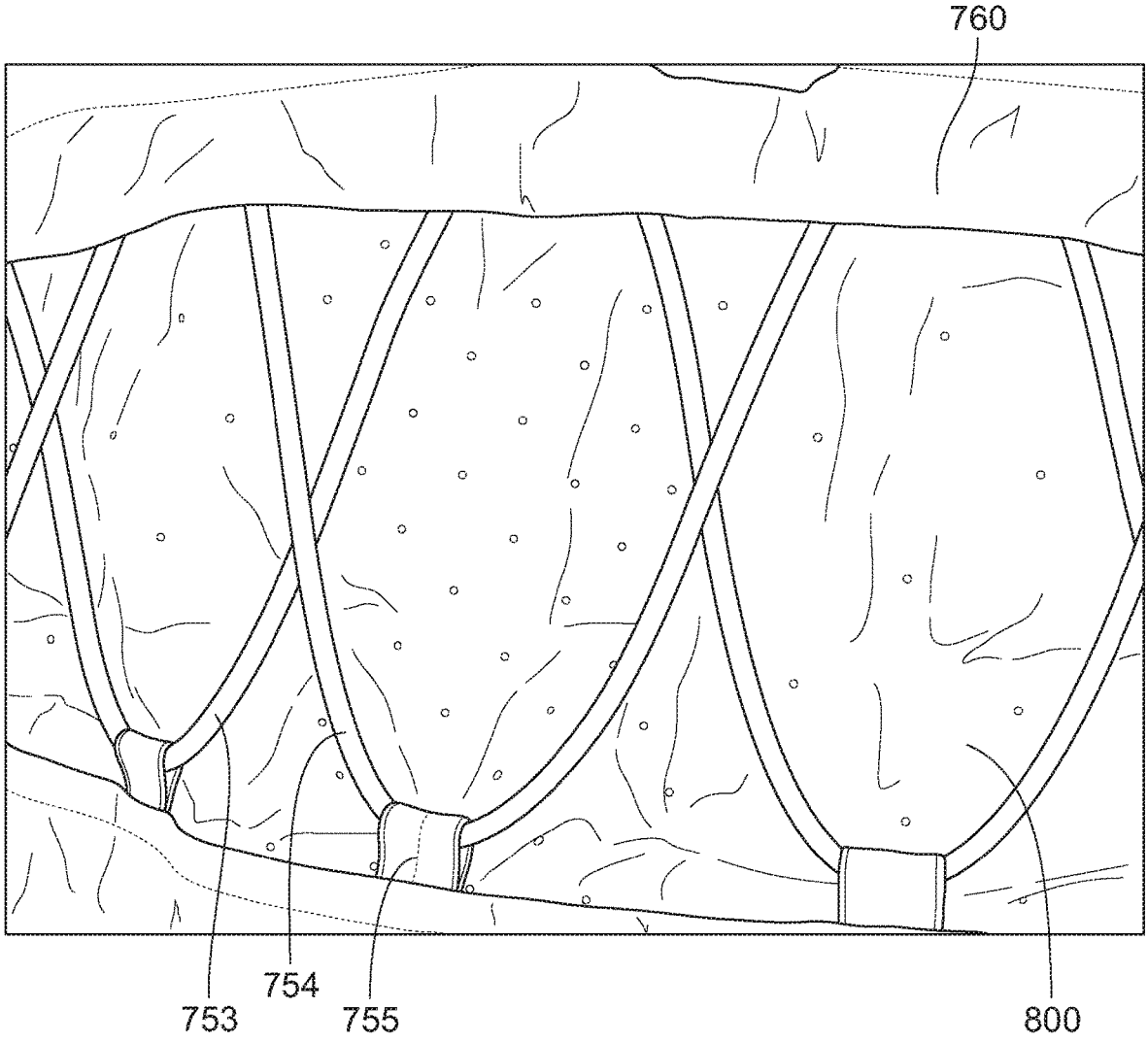
FIG. 11 is front perspective detail view illustrating the cords of the vent of the example garment of FIG. 1.

FIG. 10 is a detail view illustrating the vent panel 800 of the example garment 100 of FIG. 1 in isolation. FIG. 11 is front perspective detail view illustrating the shockcords 753, 754 of the vent 700 of the example garment 100 of FIG. 1. And, FIG. 12 is a cross-sectional detail view taken along line A-A in FIG. 7 illustrating a portion of the vent 700 and vent panel 800 of the example garment 100 of FIG. 1.

Figure 12:
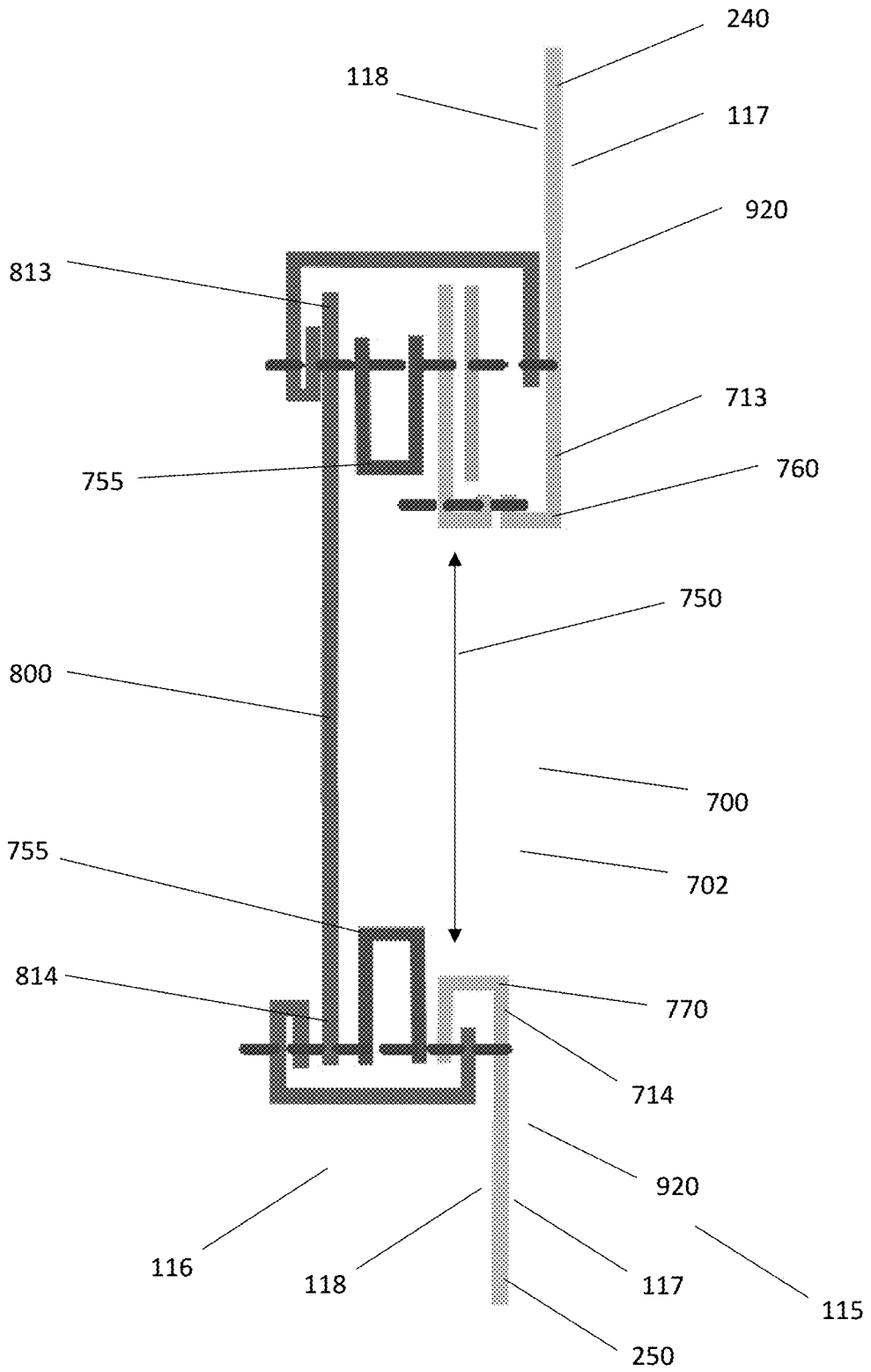
FIG. 12 is a cross-sectional detail view taken along line A-A in FIG. 7 illustrating a portion of the vent and vent panel of the example garment of FIG. 1.

In one embodiment, as shown in FIG. 12, the fasteners 755 attached to the upper edge 713 at the vent 700 are attached to the inner surface 118 of the outer panel 920 of the garment 100 (e.g., to the upper back portion 240, etc.) above the upper edge 713. In this embodiment, the upper edge 713 forms an upper flap 760 which overlaps the fasteners 755. Similarly, the fasteners 755 attached to the lower edge 714 at the vent 700 are attached to the inner surface 118 of the outer panel 920 of the garment 100 (e.g., to the lower back portion 250, etc.) below the lower edge 714. In this embodiment, the lower edge 713 forms a lower flap 770 which at least partially overlaps the fasteners 755. Advantageously, the upper and lower flaps 760, 770 protect the loops 755 from the elements and damage and may at least partially conceal the fasteners 755 from view. In the illustrated example the one or more fasteners 755 is a plurality of loops. In various embodiments the one or more fasteners can be grommets, lugs, hooks, eyelets, clasps, and a fabric channel with openings formed therein in proximity to the edges 713, 714.

In one embodiment, the vent liner or inner panel (or fabric panel) 800 is attached over the vent 700 on the inside 116 of the garment 100. As shown in FIG. 12, the upper and lower edges 813, 814 of the vent panel 800 are attached to inner surfaces 118 of the outer panel 920 at the upper and lower edges 713, 714 at the vent 700, respectively, behind (or toward the inside 116 of the garment 100) the fasteners 755. The vent panel 800 may be made of a mesh material to allow ventilating air to enter and exit the garment 100 through the vent 700. Alternatively, as shown in FIG. 10, the vent panel 800 may have holes or perforations 850 formed therein to allow ventilating air to enter and exit the garment 100. The perforations 850, such as their sizes or pattern can be engineered to form at least one first zone providing a first level of airflow therein and at least one second zone providing a second level of airflow. For example, the first level of airflow can be greater than the second level of airflow. In the illustrated example of FIG. 10, the at least one first zone can be along and around the central axis 119 where the density of perforations 850 is greater than the density of perforations 850 in the at least one second zone positioned at either end (or edge) 811, 812 of the vent panel 800. This provides greater ventilation proximate the centre of the wearer's back 5050 when the garment 100 is worn. In various embodiments, the airflow level in the at least one first and second zones can be engineered by changing the sizes, density or design pattern of the perforations 850 in the zones or any combination thereof. The shape of the vent panel 800 may be matched or approximately matched to that of the vent 700 (e.g., crescent or bow-shaped, etc.) and may fold into the inside 116 of the garment 100 when the vent 700 is moved between the opened and closed positions 702, 701.

In some embodiments, the vent/inner panel 800 can provide one more of ventilation, breathability, a thermal fabric surface or a mesh surface for insect protection. In addition, the vent panel 800 can comprise a solar panel, a light emitting diode (LED) panel, a reflective fabric detail, a glow in the dark fabric detail, a color changing fabric detail, a pH level color changing responsive fabric, a biometric indicator color changing responsive fabric and/or a light exposure color changing responsive fabric. The vent panel 800 can further comprise a waterproof fabric surface, an access to concealed storage, a material or fabric to change in the fabric transparency for changed visibility for the wearer of the garment and/or a material or fabric to change in the fabric transparency for changed sun exposure for the wearer of the garment.

In some embodiments, the panel 800 can comprise one or more of a contrasting decorative detail, a logo, and/or a graphic design element.

In one embodiment, the opening (or vent) 700 may extend horizontally (or approximately horizontally) between the upper and lower back panels 240, 250 only without extending into the sleeves 300, 400 of the garment 100. In another embodiment, the vent 700 may extend vertically proximate the central axis 119 on the back 112 of the garment 100 at least partially between the upper and lower edges 203, 204 of the body 200 of the garment 100. In further embodiments, the vent 700 may be positioned diagonally, at an angle, etc. In yet further embodiments, the vent 700 may be positioned on one or more of the front 111, sides 113, 114, sleeves 300, 400, and hood 500 of the garment 100.

In one embodiment, the panels 210, 220, 230, 240, 250, 260, 310, 410, 510, 920 of the body 200, sleeves 300, 400, and hood 500 of the garment 100 may be made from, for example, a Glyde™ 1L, Raised Grid Ripstop, 83 gsm, Non-PVC fabric. The vent panel 800 and fasteners 755 may be made from a Glyde™ Nylon Crinkly Weft, 80 gsm, Non-PVC, DWR ("durable water repellent") fabric. And, the shockcords 753, 754 may be made from a non-stretch, two dotted, silver reflective, 25 mm, Paracord™ material.

Figure 13:
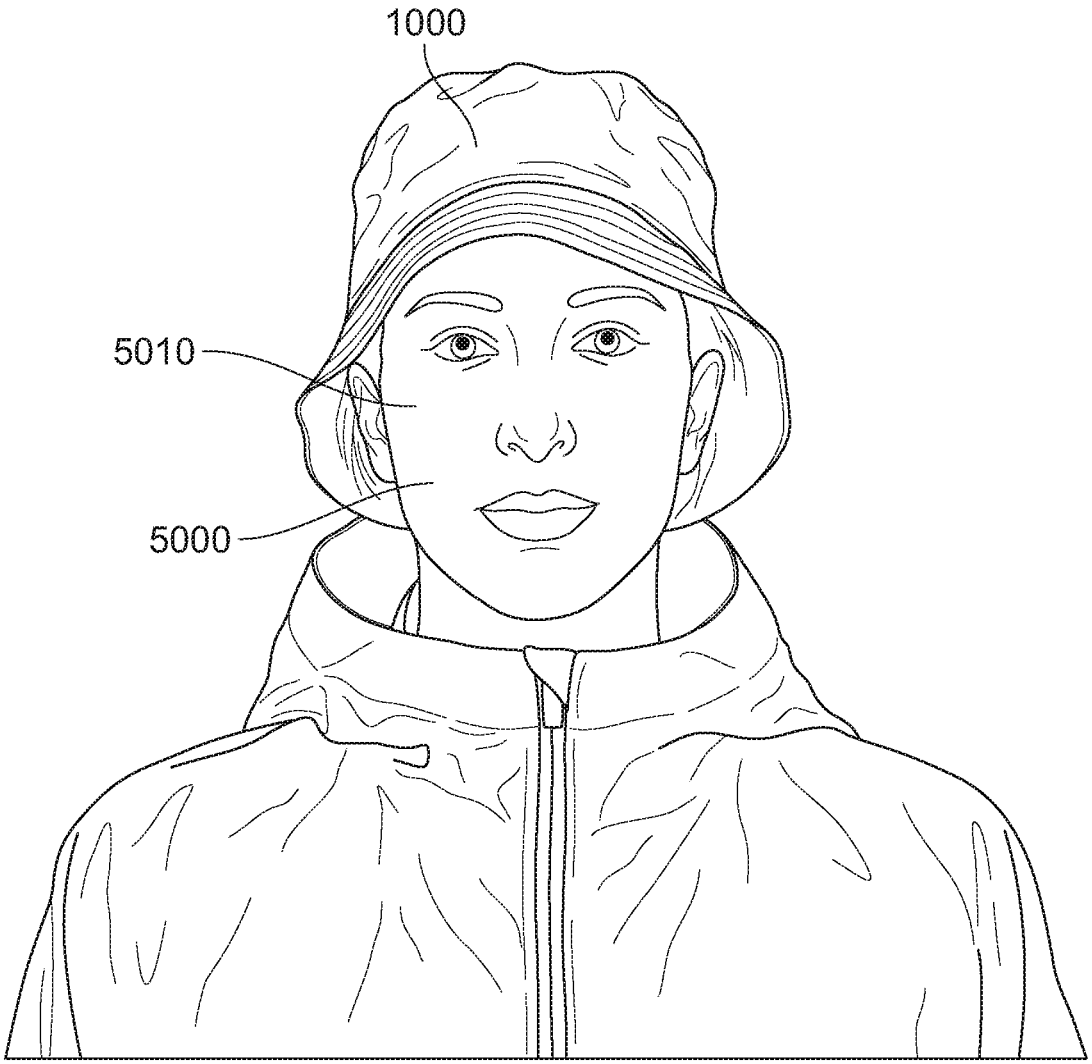
FIG. 13 is a front view illustrating another example garment having a cinchable or adjustable vent.
Figure 14:
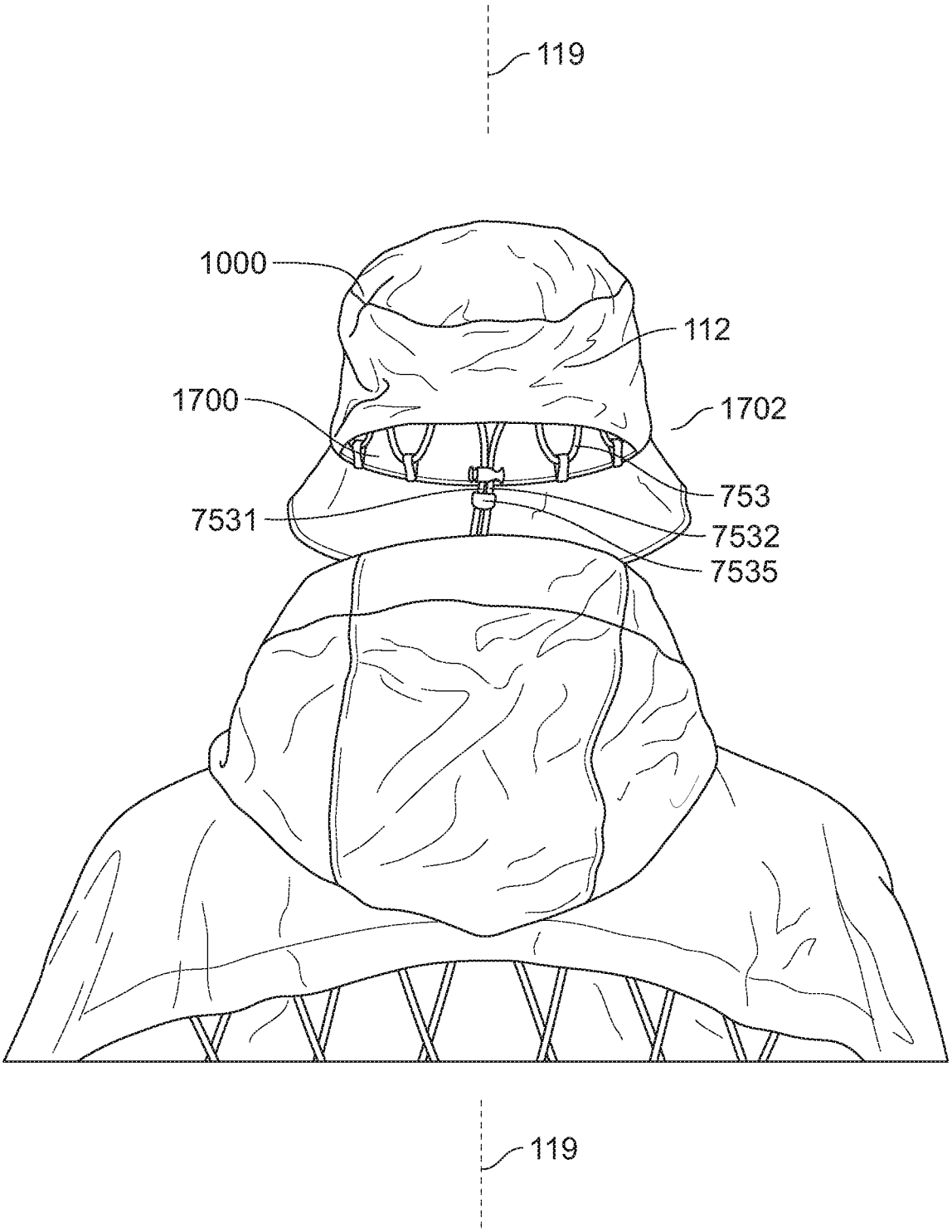
FIG. 14 is a rear view thereof showing the cinchable or adjustable vent in an opened position.
Figure 15:
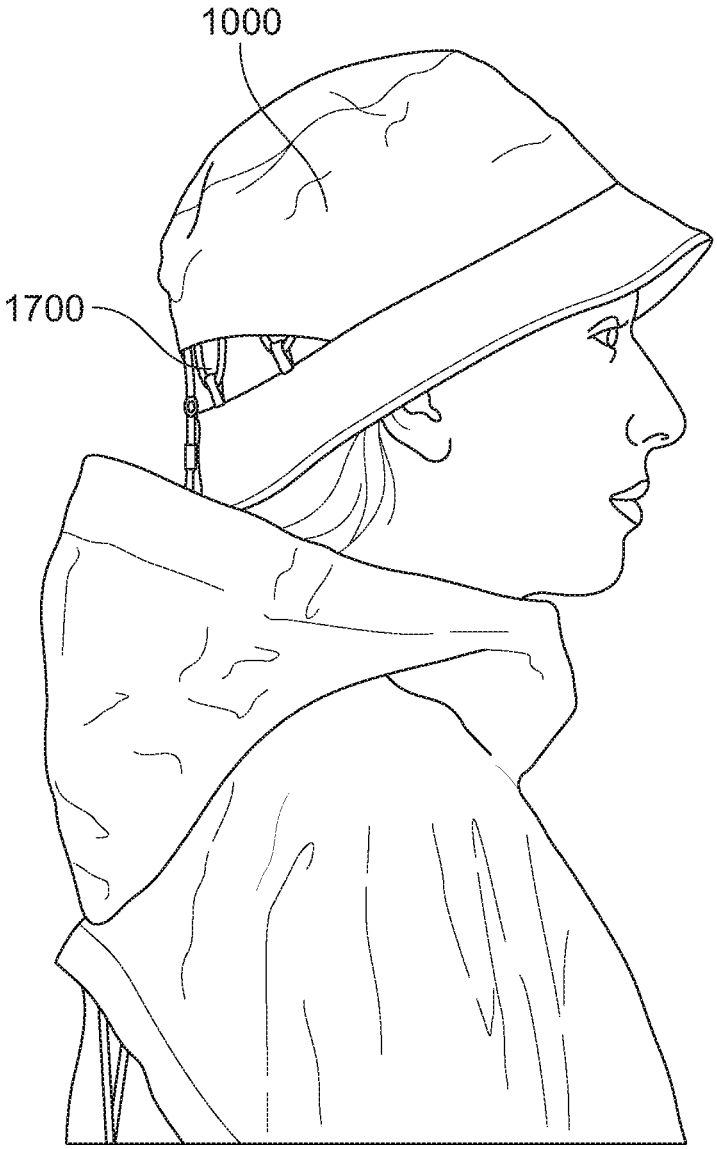
FIG. 15 is a left side view thereof, the right side view being a mirror image thereof.

FIG. 13 is a front view illustrating another example garment 1000 having a cinchable or adjustable vent 1700 thereof shown in an opened position 1702 and being worn by a wearer 5000. FIG. 14 is a rear view thereof. And, FIG. 15 is a left side view thereof, the right side view being a mirror image thereof.

The garment 1000 may be a head covering, hat, cap, or the like. The garment 1000 is for covering at least a portion of the head 5010 of the wearer 5000. As shown in FIGS. 13-15, the vent 1700 is positioned on the back 112 of the garment 1000 and the first and second ends 7531, 7532 of the single shockcord 753 and the single cord lock 7535 are positioned proximate the central axis 119 of the garment 1000.

In operation, a wearer (or user) 5000 may adjust the level of ventilation provided by the vent (e.g., 700) (i.e., the height 750 of the vent 700) and the length 751 of the back 112 of the garment (e.g., 100) by adjusting (i.e., tightening or loosening) the shockcords 753, 754. In some cases, the wearer 5000 may adjust the shockcords 753, 754 when the garment 100 is being worn (i.e., without taking the garment 100 off).

Advantageously, the adjustable vent (e.g., 700) of the example garment (e.g., 100) allows a wearer 5000 to easily adjust the level of ventilation or airflow provided through the vent 700 and to adjust the fit of the garment 100 by transforming (or reconfiguring, repurposing, converting, etc.) the garment 100 into a shorter length 751 garment 100. This allows the wearer 5000 to continue to wear the garment 100 when weather conditions change (e.g., the temperature rises, etc.) or when the wearer 5000 desires a different look or fit.

In one embodiment, the adjustable opening 700 functions as a vent to adjust the level of ventilation or airflow provided by the inner panel 800. In one embodiment, the adjustable opening 700 conceals and/or exposes (or disables/enables or covers/uncovers or reduces/increases) one or more non-ventilation related (i.e., non-airflow related) functional and/or aesthetic aspects provided by the inner panel 800. In one embodiment, the adjustable opening 700 functions as a vent to adjust the level of ventilation or airflow provided by inner panel 800 and also conceals and/or exposes one or more other functional and/or aesthetic aspects of the inner panel 800.

For example, as mentioned above, the inner panel 800 may include one or more of a contrasting decorative detail, a logo, and/or a graphic design element. These elements may have functional aspects, aesthetic aspects, or both functional and aesthetic aspects. For example, a contrasting decorative detail may provide a signal, warning, or other information in addition to decoration. When cinched (i.e., when the opening 700 is closed), the inner panel's functional and/or aesthetic aspects are concealed, covered, disabled, or reduced (or at least partially concealed, covered, disabled, or reduced). When uncinched (i.e., when the opening 700 is opened), the inner panel's functional and/or aesthetic aspects are exposed, uncovered, enabled, or increased (or at least partially exposed, uncovered, enabled, or increased).

In an embodiment, there is provided a garment, comprising: an outer panel having an opening with an edge formed therein (or therearound); an inner panel attached to the outer panel behind the opening; a cord traversing the opening formed in the outer panel; one or more fasteners attached to the outer panel proximate to the opening formed in the outer panel for securing the cord, the cord slidably passing through the one or more fasteners; and, one or more locks to hold the cord in a set position, wherein the one or more locks are configured to selectively adjust tension in the cord to open and close the opening.

In an embodiment, the outer panel is an outer layer and wherein the garment further comprises one or more additional layers. In an embodiment, the inner panel includes one or more inner panels. In an embodiment, the opening is formed between one or more outer panels. In an embodiment, the cord forms a laced pattern or design when the opening is opened.

In an embodiment, the cord is concealed when the opening is closed, wherein the inner panel is concealed when the opening is closed, and wherein the inner panel is exposed when the opening is opened. In an embodiment, the garment is one of a jacket, a coat, a parka, a vest, a tunic, a dress, a sweater, a swimsuit, a swim cover-up, a shirt, a bra, pants, leggings, shorts, a skirt, a jumpsuit, a hat, a belt, a running belt, a scarf, and a face mask. In an embodiment, the cord is attached to inner surfaces of the outer panel.

In an embodiment, one or more of: the inner panel is made from a different fabric material type than the outer panel; the inner panel has a different fabric coating than the outer panel; the inner panel has a different fabric weight than the outer panel; the inner panel has a different weave pattern than the outer panel; the inner panel has a different applied surface than the outer panel; and, the inner panel has a different fabric color than the outer panel. In an embodiment, the inner panel has perforations formed therein to allow airflow therethrough and into the garment, sizes of the perforations and/or a pattern of the perforations engineered to form at least one first zone providing a first level of airflow therein and at least one second zone providing a second level of airflow therein. In an embodiment, the inner panel comprises one or more of: a ventilation surface; a breathability surface; a thermal fabric surface; a mesh surface for insect protection; a waterproof fabric surface; an access to concealed storage; a solar panel; a light emitting diode (LED) panel; a material to change in the size of the garment; a material to change in the fit of the garment; a material to change in the fabric transparency for changed visibility for the wearer of the garment; a material to change in the fabric transparency for changed sun exposure for the wearer of the garment; a material to change in the length of the garment; a reflective fabric detail; a glow in the dark fabric detail; a color changing fabric detail; a pH level color changing responsive fabric; a biometric indicator color changing responsive fabric; and/or, a light exposure color changing responsive fabric. In an embodiment, the inner panel comprises one or more of a contrasting decorative detail, a logo, and a graphic design element.

In an embodiment, the cord is or is made from one or more of polyester, braided polyester, paracord, braided nylon, flexible LED, recycled nylon, and recycled polyester. In an embodiment, the cord is one or more of reflective, glow in the dark, light reactive, heat reactive, water reactive, reactive to a specific chemical, transparent, and translucent. In an embodiment, the fasteners are one or more of loops, grommets, lugs, hooks, eyelets, clasps, and a fabric channel with openings formed therein.

In an embodiment, the one or more locks configured to hold the cord in a set position for selectively adjusting tension in the cord comprises at least one of: a cord lock, a toggle, a buckle, a snap fastener, a button, a hook, a loop, a knot, a series of cord locks, a series of toggles, a series of buckles, a series of snap fasteners, a series of buttons, a series of hooks, a series of loops, and a series of knots. In an embodiment, the cord extends within the garment and the one or more locks holding the cord in a set position for selectively adjusting tension in the cord are accessible proximate to one of more of a sleeve cuff of the garment, a waistband of the garment, a front opening fastener of the garment, a hood adjustment means of the garment, and a pocket of the garment.

In an embodiment, the opening is two or more openings, wherein the inner panel is two or more respective inner panels, wherein the cord is two or more respective cords, wherein the one or more fasteners is two or more respective fasteners, and wherein the one or more locks to hold the cord in a set position is two or more respective locks. In an embodiment, the opening is one of horizontal, vertical, diagonal, forming a pattern, curved, straight, and jagged.

In an embodiment, the garment is an outer garment. In an embodiment, the garment is one of a head covering, cap, and hat. In an embodiment, the outer panel is an outer layer of the garment or portion thereof. In an embodiment, the inner panel is an inner layer or liner of the garment or portion thereof. In an embodiment, the outer panel is located on a back side of the garment. In an embodiment, the opening is a vent. In an embodiment, the inner panel is a vent panel or liner. In an embodiment, the outer panel is a back panel of the garment. In an embodiment, the outer panel includes an upper back panel and a lower back panel and the opening is formed between a lower edge of the upper back panel and an upper edge of the lower back panel. In an embodiment, the opening extends into first and second sleeves of the garment. In an embodiment, a density of perforations proximate a central axis of the inner panel is greater than the density of perforations proximate each end of the inner panel.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this application are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Any example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A garment, comprising:

a back side configured to cover at least a portion of a torso of a wearer when worn, the back side having:

an outer panel having: a length extending from a neck opening to a waist opening; an upper back panel having a lower edge extending approximately horizontally across the back side between a first end and a second end; and, a lower back panel having an upper edge extending approximately horizontally between the first end and the second end; wherein the lower edge of the upper back panel and the upper edge of the lower back panel are not attached between the first end and the second end thereby forming an opening therebetween; and, wherein the opening extends into first and second sleeves of the garment;

a cord traversing the opening formed in the outer panel;

one or more fasteners attached to the upper back panel and the lower back panel of the outer panel proximate to the opening formed in the outer panel for securing the cord, the cord slidably passing through the one or more fasteners; and, one or more locks to hold the cord in a set position, wherein the one or more locks are configured to selectively adjust tension in the cord to open and close the opening;

wherein the lower back panel of the outer panel is moveable between an opened position and a closed position, and wherein when the lower back panel is in the opened position the opening is opened and the length is a first length and when the lower back panel is in the closed position the opening is closed and the length is a second length that is shorter than the first length.

2. The garment of claim 1, wherein the outer panel is an outer layer and wherein the garment further comprises one or more additional layers.

3. The garment of claim 1, further comprising an inner panel attached to the outer panel behind the opening, an upper edge of the inner panel being attached to the upper back panel of the outer panel, and a lower edge of the inner panel being attached to the lower back panel of the outer panel.

4. The garment of claim 3, wherein the cord is concealed when the opening is closed, wherein the inner panel is concealed when the opening is closed, and wherein the inner panel is exposed when the opening is opened.

5. The garment of claim 1, wherein the garment is one of a jacket, a coat, a parka, a vest, a tunic, a dress, a sweater, a swimsuit, a swim cover-up, a shirt, and a bra.

6. The garment of claim 1, wherein the cord is attached to inner surfaces of the outer panel.

7. The garment of claim 1, wherein the opening is formed between one or more outer panels.

8. The garment of claim 3, wherein the inner panel comprises one or more inner panels.

9. The garment of claim 1, where the cord forms a laced pattern or design when the opening is opened.

10. The garment of claim 3, wherein one or more of: the inner panel is made from a different fabric material type than the outer panel; the inner panel has a different fabric coating than the outer panel; the inner panel has a different fabric weight than the outer panel; the inner panel has a different weave pattern than the outer panel; the inner panel has a different applied surface than the outer panel; and, the inner panel has a different fabric color than the outer panel.

11. The garment of claim 3, wherein the inner panel has perforations formed therein to allow airflow therethrough and into the garment, sizes of the perforations and/or a pattern of the perforations engineered to form at least one first zone providing a first level of airflow therein and at least one second zone providing a second level of airflow therein.

12. The garment of claim 3, wherein the inner panel comprises one or more of: a ventilation surface; a breathability surface; a thermal fabric surface; a mesh surface for insect protection; a waterproof fabric surface; an access to concealed storage; a solar panel; a light emitting diode (LED) panel; a material to change in the size of the garment; a material to change in the fit of the garment; a material to change in the fabric transparency for changed visibility for the wearer of the garment; a material to change in the fabric transparency for changed sun exposure for the wearer of the garment; a material to change in the length of the garment; a reflective fabric detail; a glow in the dark fabric detail; a color changing fabric detail; a pH level color changing responsive fabric; a biometric indicator color changing responsive fabric; and/or, a light exposure color changing responsive fabric.

13. The garment of claim 3, wherein the inner panel comprises one or more of a contrasting decorative detail, a logo, and a graphic design element.

14. The garment of claim 1, wherein the cord is or is made from one or more of polyester, braided polyester, paracord, braided nylon, flexible LED, recycled nylon, and recycled polyester.

15. The garment of claim 1, wherein the fasteners are one or more of loops, grommets, lugs, hooks, eyelets, clasps, and a fabric channel with openings formed therein.

16. The garment of claim 1, wherein the one or more locks configured to hold the cord in a set position for selectively adjusting tension in the cord comprise at least one of: a cord lock, a toggle, a buckle, a snap fastener, a button, a hook, a loop, a knot, a series of cord locks, a series of toggles, a series of buckles, a series of snap fasteners, a series of buttons, a series of hooks, a series of loops, and a series of knots.

17. The garment of claim 3, wherein the opening is two or more openings, wherein the inner panel is two or more respective inner panels, wherein the cord is two or more respective cords, wherein the one or more fasteners is two or more respective fasteners, and wherein the one or more locks to hold the cord in a set position is two or more respective locks.

18. The garment of claim 1, wherein the opening is one of horizontal, vertical, diagonal, forming a pattern, curved, straight, and jagged.

19. The garment of claim 1, wherein the garment is an outer garment.

20. The garment of claim 1, wherein the opening has a crescent shape and wherein, in the opened position, the opening narrows proximate each of the first end and the second end and widens proximate a central axis of the back side.

* * * * *